US009631317B2

(12) United States Patent
Kuusisto

(10) Patent No.: US 9,631,317 B2
(45) Date of Patent: Apr. 25, 2017

(54) METHOD FOR DISPLACEMENT IN BATCH DIGESTERS

(71) Applicant: Valmet AB, Sundsvall (SE)

(72) Inventor: Petteri Kuusisto, Pori (FI)

(73) Assignee: VALMET AB, Sundsvall (SE)

( * ) Notice: Subject to any disclaimer, the term of this patent is extended or adjusted under 35 U.S.C. 154(b) by 6 days.

(21) Appl. No.: 14/951,520

(22) Filed: Nov. 25, 2015

(65) Prior Publication Data

US 2016/0153138 A1 Jun. 2, 2016

(30) Foreign Application Priority Data

Nov. 27, 2014 (SE) ..... 1451445

(51) Int. Cl.

| | |
|---|---|
| ***D21C 3/26*** | (2006.01) |
| ***D21C 7/12*** | (2006.01) |
| ***D21C 1/00*** | (2006.01) |
| ***D21C 3/00*** | (2006.01) |
| ***D21C 7/00*** | (2006.01) |

(52) U.S. Cl.

CPC ..... *D21C 3/26* (2013.01); *D21C 1/00* (2013.01); *D21C 3/00* (2013.01); *D21C 7/00* (2013.01); *D21C 7/12* (2013.01)

(58) Field of Classification Search

CPC ... D21C 1/00; D21C 1/02; D21C 1/04; D21C 7/12; D21C 7/08

See application file for complete search history.

(56) References Cited

U.S. PATENT DOCUMENTS

| | | | | |
|---|---|---|---|---|
| 5,059,284 | A * | 10/1991 | Fagerlund | D21C 7/14 162/239 |
| 5,080,757 | A * | 1/1992 | Fagerlund | D21C 7/14 162/37 |
| 5,676,795 | A | 10/1997 | Wizani | |
| 6,413,367 | B1 * | 7/2002 | Svedman | D21C 1/04 162/41 |
| 6,533,896 | B1 * | 3/2003 | Tikka | D21C 3/02 162/19 |
| 8,951,388 | B2 * | 2/2015 | van Lee | D21C 3/02 162/18 |
| 2006/0231222 | A1 * | 10/2006 | Bianchini | D21C 7/14 162/47 |
| 2011/0272110 | A1 * | 11/2011 | Leite | D21C 3/02 162/90 |
| 2016/0130753 | A1 * | 5/2016 | Rosengren | D21C 1/00 162/41 |

FOREIGN PATENT DOCUMENTS

| | | |
|---|---|---|
| EP | 0796367 | 7/1995 |
| EP | 2430233 | 3/2012 |
| EP | 2567023 | 3/2013 |
| SE | WO2012158075 | 11/2012 |

* cited by examiner

*Primary Examiner* — Anthony Calandra
(74) *Attorney, Agent, or Firm* — Fasth Law Offices; Rolf Fasth

(57) ABSTRACT

The method is for producing pulp in batch digesters. More particularly, the method is for ending a treatment phase of the digester content. In order to obtain a more uniform pulp quality from the process is the treatment phase ended by displacing a liquor volume (WLP) through the digester vessel with an imposed increasing temperature in the displacement liquor added to digester.

9 Claims, 8 Drawing Sheets

METHOD FOR DISPLACEMENT IN BATCH DIGESTERS

PRIOR APPLICATION

This is a US national phase application that claims priority from Swedish patent application no. SE 1451445-9, filed 27 Nov. 2014.

FIELD OF THE INVENTION

The present invention relates to a method for producing pulp. More particularly, it concerns a displacement batch cooking process comprising a displacement phase using a temperature gradient in the displacement liquor used.

BACKGROUND OF THE INVENTION

The prehydrolysis-sulfate (Kraft) cooking for the production of special pulps having a high content of alpha cellulose was developed in the 1930's, see e.g. Rydholm, S. E., Pulping Processes, pp. 649 to 672, Interscience Publishers, New York, 1968. The basic idea is to remove as much hemicellulose as possible from cellulose fibers in connection with delignification, so as to obtain a high content of alpha cellulose. This is essential because the various end uses of such pulps, dissolving pulp for instance, do not tolerate short-chained hemicellulose molecules with a randomly grafted molecular structure.

A separate prehydrolysis step permits the desired adjustment of the hydrolysis of hemicelluloses by varying the hydrolysis conditions. In the prehydrolysis-kraft cooking process the necessary delignification is not carried out until a separate second cooking step. The prehydrolysis is carried out either as a steam or water phase prehydrolysis, or in the presence of a catalyst. In the former "steam" processes, organic acids liberated from wood during the process establish the necessary pH conditions and perform a major part of the hydrolysis, whereas in the latter "water" process, small amounts of mineral acid or sulfur dioxide may be added to "assist" the prehydrolysis. In the prehydrolysis stage carried out in a steam phase, often called autohydrolysis, direct steam is introduced to the chip column in the digester. Conventionally, autohydrolysis is established at some 30-40° C. higher temperature than in liquid filled hydrolysis.

Conventionally after prehydrolyzing the cellulosic material in a reactor, the hydrolysate and the prehydrolyzed cellulosic material are neutralized in the reactor with alkaline neutralizing liquor so as to produce neutralized hydrolysate and neutralized prehydrolyzed cellulosic material. There is hydrolysate both in the free liquid outside the chips and also trapped and immobilized inside the chips. In Bio Pulping, as much as possible of the hydrolysate can be recovered before the neutralization step in order to be able to utilize the carbohydrates released in the prehydrolysis as an additional product from the mill. A separate washing stage, in which the digester is first filled up with a washing liquid and then the liquid containing the carbohydrates is removed from the digester, can be used between the prehydrolysis and cooking stages. Conventionally, both the liquid filling of the digester as well as removal of the dissolved carbohydrates are done by a displacement process using heated wash liquors, all in order to maintain the temperature of the cellulose material.

EP 2430233 discloses another method to recover the hydrolysate from a steam phase prehydrolysis. In EP 2430233 hot water is introduced into the digester after prehydrolysis at top and bottom and subjected to internal circulation while filling the digester. The water filling may be continued until the entire chip volume inside digester is drenched in water. The hot water is heated to the intended temperature and stored in hot water accumulator before usage. The heating is done up to a temperature close to the temperature of the hydrolysis.

Also, a sequence of multiple displacement liquors may be used in a sequence during displacement, and one such sequence is shown in EP796367. After a prehydrolysis at some 170° C. is the hydrolysate neutralized by displacing a hot white liquor pad through the digester at some 155° C., and thereafter is kraft cooking commenced using spent cooking liquor at some 148° C. in a first phase. A problem here is that the very first portion of the hot white liquor pad that meets the hot acidic chips both is heated by the chips and due to exothermic reactions further elevate the temperature in the white liquor pad, and this while the alkali content is consumed. Thus, the last upper volume of the digester content will be exposed to a hot and alkali depleted white liquor pad that is not able to end the prehydrolysis. This will cause an extended prehydrolysis in upper part of digester in comparison to lower part, and the difference in prehydrolysis effect between upper and lower part of digester could be some 17-150%.

Similar displacement using a white liquor pad, added in volume at some 30 $m^3$ in a digester with a total volume about 300 $m^3$, is also disclosed in EP2567023, but ahead of a CCE-filtrate added in volume at some 130 $m^3$. Sequential displacement from bottom is also disclosed for hot black liquor filling as well as final liquor displacement. All displacement liquors used having an isothermal temperature when adding them to the digester.

While the processes hereto has been optimized for maintaining the established heat value in the digester, i.e. avoiding losses of heat value in the process, most implementations has used excessive heating of process liquors added after a hot treatment stage. The objective in this excessive heating has been to maintain the temperature of the content of the digester high, avoiding the losses that may be at hand if the digester is first elevated to a high process temperature, then lowered in temperature, followed by heating again to establish a higher temperature. Each such swing in temperature leads to heat losses per default, even if heat recovery is implemented after each phase.

The system has thus been designed with large accumulators for storing the heated process liquors, which accumulators are equipped with circulation systems and heat exchangers in order to heat the liquors to this elevated temperature before use at the specific treatment phase.

What is also seen in the prior art is that even if these high temperature liquors are used to end a treatment phase, the digester content is subjected to different H-factor exposure as of content close to bottom VS content close to top, and especially if the temperatures differ between phases. Using an isothermal displacement liquor after a hot treatment phase, and a somewhat colder displacement liquor to the bottom of the digester, will impose a larger cooling effect on the digester material contained in the bottom VS the digester material contained in the upper part. This due to that the displacement liquor will be heated by the digester material during displacement and in some cases due to exothermic reactions. At the instant where the displacement front reach the top is the temperature of the free displacement liquor often more than 20-40° C. higher than the temperature of the displacement liquor last added to the bottom. Now, the temperature profile may be even out afterwards by circulation, but the harm has already been done at the moment this temperature profile is obtained.

OBJECT OF THE INVENTION

The object of the present invention is to improve a displacement following a general heated treatment stage which will result in better uniformity in the pulp produced. It is especially the uniformity of pulp, as seen in over the extension of the digester between top and bottom that is improved as the P- or H-factor will be more similar over the entire content of the digester.

H-factor is a kinetic model for the rate of delignification in kraft pulping. It is a single variable model combining temperature (T) and time (t) and assuming that the delignification is one single reaction (see Herbert Sixta, Handbook of Pulp, Volume 1, Wiley-VCH Verlag 2006, pages 343-345), and P-factor is the equivalent factor for hydrolysis processes also taking the temperature and time into account.

For H-factor the delignification process doubles the reaction rate for each 8-10° C. increase starting from a temperature of about 90-100° C. where the delignification rate is almost 0 at all practical retention times and at single H-factor digits even at a retention time of 400 minutes at 100° C.

For the hydrolysis process the P-factor during 10 minutes is about 100 units at 170° C., only 20 units at 150° C. and practically neglect able at 130° C. Hence, for controlling the appropriate ending of a prehydrolysis sufficient low temperature should be established.

For ending a prehydrolysis stage it is necessary to change the conditions favoring the prehydrolysis reactions, i.e. a low pH and high temperature. In the prior art has hot white liquor been charged that at end of displacement may be heated to full prehydrolysis temperature or even higher, and this requires excessive charges of white liquor. With the invention the alkali charge may be reduced as an effective lowering of the temperature is established.

As process liquors may be used at start of displacement, not requiring heating before use, could saving in heating (less use of steam) be obtained in first phases. The necessary heating accumulators may also be smaller (less investment) as the necessary volumes of heated liquors decrease.

The present invention may be applied after any kind of heated treatment phase, where the treatment result on the material content in the digester is a result of exposure of time and temperature, i.e. H-factor or P-factor.

The present invention may preferably be applied after hydrolysis, both after steam hydrolysis, as well as liquid filled hydrolysis. The present invention is preferably applied in a prehydrolysis kraft process, where first prehydrolysis is performed at high temperatures in the order of 170° C., while subsequent black liquor impregnation is implemented at quite lower temperature below 155° C., even as low as down to 100° C., which impregnation is followed by cooking at some 135-170° C.

However, any displacement phase after impregnation or cooking liquor establishment as well as final wash may benefit from the invention, as more total equal H-factor may be obtained for the entire digester content. Equal impregnation effect is also a necessity ahead of cooking in order to obtain same pulp quality of the digester content.

SUMMARY OF THE INVENTION

The present invention is related to a method for ending a heated treatment phase in a displacement batch pulping process in a digester vessel, where the treatment phase has been done at a treatment temperature above 130° C., preferably above 150° C. The digester has at least a bottom, a mid-point and a top liquid exchange position. The method is initiated after the heated treatment phase and has the following steps;

- adding a first displacement liquor to the bottom liquid exchange position while having a first lower temperature more than 20° C. below the treatment temperature in the first displacement liquor at start of the displacement filling a part of the digester with a first volume of an first displacement liquor,
- continuing to add the same first displacement liquor to the bottom liquid exchange position while having a higher second temperature in the first displacement liquor in a later phase of the displacement filling at least a part of the digester with a total second volume of the first displacement liquor larger than the first volume,
- and optionally continuing the displacement with a final displacement liquor.

By this principle could the temperature profiling of the displacement liquor reduce the residual H-factor exposure on the digester content of cellulosic material from the preceding heat treatment, obtaining less difference in pulp quality between the pulp blown first and last from digester. The final displacement liquor may be a different liquor than that used for the initial displacement liquor, but they may also be the same.

A typical state of the art batch digester with a digester volume in excess of 300 $m^3$, may require some 20-30 minutes for a full displacement cycle. Hence, the P- or H-factor exposure on the digester content may differ quite a lot for the digester content, as the bottom content is effectively ending the heat treatment sooner than is obtained in the top content of the digester. Thus using a colder liquor in the first part of displacement will prevent this liquor from reaching excessive temperature at end of displacement.

According to a preferred embodiment the displacement process is improved such that the final displacement liquor is supplied and displaced until the content of the digester vessel is completely submerged under the total volume of the final displacement liquor added and wherein the first displacement liquor has been displaced from the digester via the top liquid exchange position. In this embodiment the first displacement liquor may be used entirely as a neutralization liquor with the sole objective to swing the digester content towards alkaline conditions during alkali consumption that may consume most of the alkali content.

According to yet a preferred embodiment the displacement process is improved such that after adding the first displacement liquor with the higher second temperature and before the content of the digester vessel is completely submerged is the displacement continuing by adding the same first displacement liquor to the bottom liquid exchange position while having a third temperature higher than the second temperature in the displacement liquor in a later phase of the displacement filling a part of the digester with a total third volume of first displacement liquor larger than the total second volume. In some applications more than 2 stages in the temperature profiling may be beneficial, depending on size of digester and the necessary time for starting and ending the displacement, which may take up to 10-20 minutes or more.

This may also be further improved by that the temperature in the first displacement liquor increase is done in incremental steps in at least 3 and up to 10 steps during the displacement. Alternatively, the temperature increase in the first displacement liquor may be done continuously during the displacement.

In a preferred embodiment the displacement may be succeeded with initiation of a circulation of the liquor is after the digester vessel has been filled by the final displacement liquor. This may improve further equalization of residual heat in the digester content.

In a preferred embodiment of the inventive method that is especially advantageous when using a white liquor pad as neutralization liquor after a prehydrolysis and using only 2 temperatures in a first cold and a second hot white liquor pad is the proportion of the first volume of the first displacement liquor in relation to the total volume of the first displacement liquor in the range 20-50%. This part volume of the total white liquor pad establish a sufficient part volume that could absorb most if not all of the exothermic heat release during displacement, but also most of the residual heat value of the digester content.

Also preferable when implementing the inventive method after prehydrolysis is that the total volume of the first displacement liquor is in the range 50-75% of the free digester volume, i.e. not filling the entire digester with this neutralization liquor which may reduce total alkali consumption.

In order to absorb most of the exothermic heat release and the residual heat in the digester content but still not reaching high temperatures close to those high temperatures supporting hydrolysis reactions, is preferably the first lower temperature in the first displacement liquor in the range 70-110° C., preferably 90-100° C.

As indicated before, the inventive method is preferably applied after prehydrolysis wherein the heated treatment phase is a prehydrolysis phase wherein the digester content is hydrolyzed at a temperature above 150° C. In such high temperature hydrolysis process is the residual heat value in the digester content quite high and even further heated by reaction heat formed in neutralization, so a hydrolysis effect is maintained to a large extent in final digester content volumes displaced by the displacement liquor, while first digester content volumes displaced are sooner to lower the temperature and end the hydrolysis, whereby a forced temperature profiling may reduce difference in P-factor exposure. Typically the reaction heat formation in neutralization is estimated to 0.1-0.2 GJ/tBD wood resulting in up to 10° C. temperature increase in on average for the liquor filled digester.

DETAILED DESCRIPTION OF THE INVENTION

The description will be made using the schematic layout shown in FIG. 1 which only discloses the essential components for the system used necessary to implement the present invention in a white liquor displacement phase. In a full commercial plant is also additional equipment added for performing the kraft cook and heat recovery after cook, for example using warm and hot black liquor accumulators.

Only one digester is shown but typically a number of digesters are used that operate in sequence and thus in different phases of the cook. If for example 5 digesters are operated the first digester is started and then the remaining digesters are started at some time interval which time interval may correspond to ⅕ of the total cooking cycle time for one digester. Cooked pulp may then be blow to a blow tank at regular intervals, and the process liquids stored in accumulators and atmospheric tanks may be used in another digester minimizing inactive dwell time for the liquids used. The piping system is simplified showing only one liquid addition point for WL, Wash filtrate, LP_ and MP-steam but in a real system are individual piping connected to the inlet point of the digester.

During the white liquor displacement phase is white liquor used that typically is obtained from the caustization. This white liquor conventionally has a temperature of about 90° C. as it has been stored in atmospheric tanks. The white liquor is heated before supply to the hot white liquor accumulator in at least one heat exchanger $HE_{2P}$, using hotter process liquors or steam as heating medium. The content of the hot white liquor accumulator is also heated in a circulation containing an additional heat exchanger $HE_{2C}$, using hotter process liquors or steam as heating medium. The heating is performed until the entire accumulator content has reached the intended temperature which in the figure may lie at some 150° C. lif the total digester volume is about 300 $m^3$, the total free volume inside a digester filled with comminuted chips is about 200 $m^3$, so the accumulator needs a size of 200 $m^3$ to store this volume for a full displacement phase.

Figure 2A:
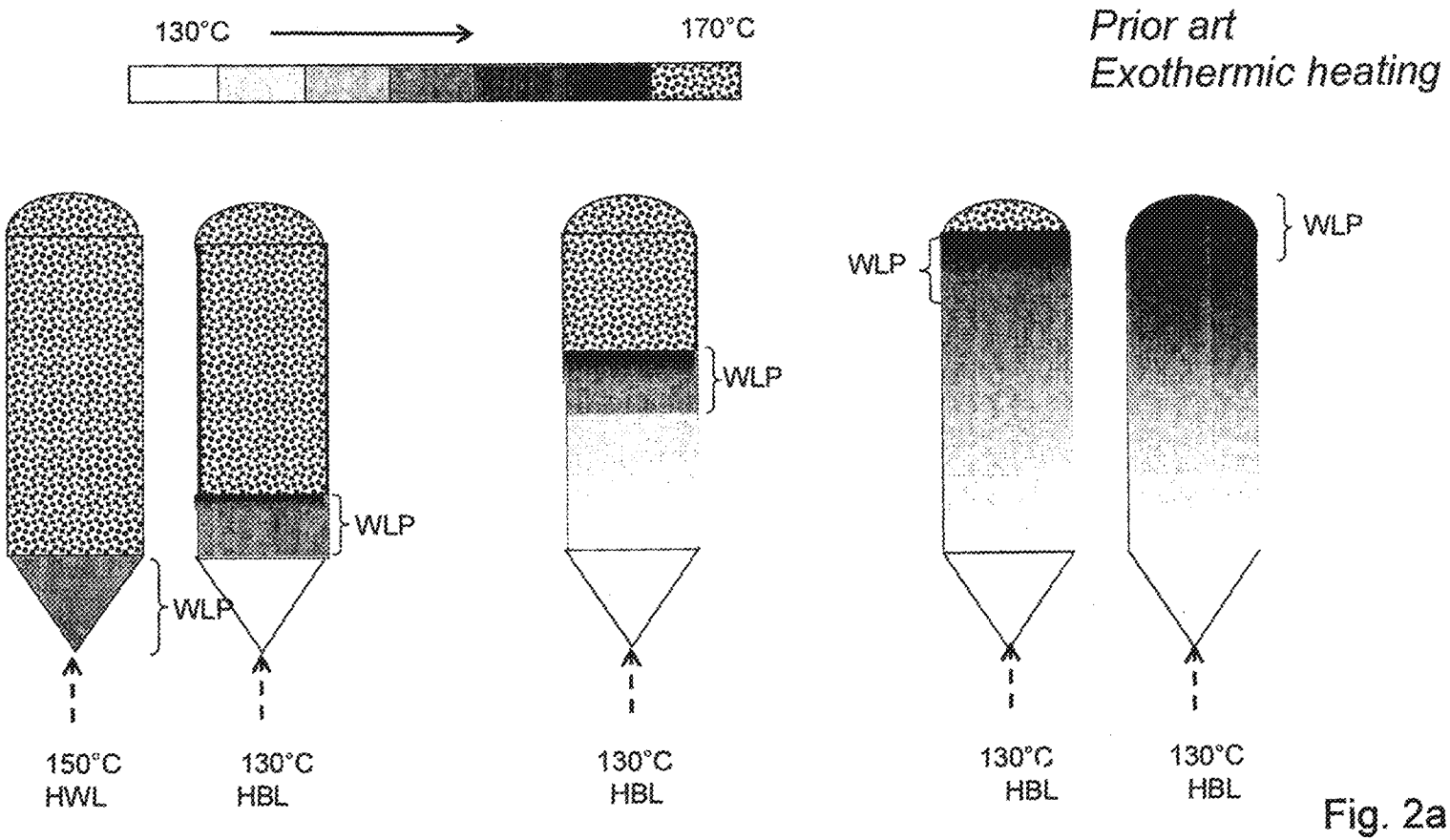
FIG. 2*a* is showing the a principle effect from exothermic reaction during a conventional displacement front through the digester using a hot white liquor pad WLP at a temperature of 150° C. displaced trough the digester.

In FIG. 2*a* is shown the principle heating effect from exothermic reactions during a conventional displacement front through the digester using a hot white liquor pad at a temperature of 150° C. In this example a drained digester is shown with a digester content of comminuted chips after a heated treatment in form of a prehydrolysis conducted at 170° C. In a first stage, first left hand figure, of the displacement phase is the inlet cone part filled with a volume of white liquor holding 150° C. when added. In a second stage, second figure from left, of the displacement phase is the inlet cone part filled with a volume of hot black liquor holding 130° C. when added, pushing the hot white liquor pad WLP upwardly. During this displacement will exothermic heat be released as alkali is consumed when the upper level of the white liquor pad neutralizes the acidic digester content but now heated to a higher temperature due to exothermic reactions. The heating effect due to exothermic reactions is in the range 0.138-0.206 GJ/odt of wood.

This continues in stages until the entire digester is filled with displacement liquor, and as a result of the heating from the exothermic reaction is a temperature profile established over the height of the digester, with a temperature of the free liquor close to the hydrolysis temperature, i.e. close to 170° C. in top but close to 130° C. in bottom. Now, the digester content in bottom has been flushed by 130° C. wash liquor during the entire displacement and is very close to 130° C. But the digester content in top has only been drenched by heated white liquor with most of the alkali content consumed during neutralization. As a result the hydrolysis is ended much sooner in bottom of digester, as the temperature has been lowered to 130° C. at an early stage and alkali has been present, while the digester content in the top is subjected to extended hydrolysis, as the criteria's for ending the hydrolysis, lowering of temperature and change to alkaline conditions has not been fulfilled.

Figure 2B:
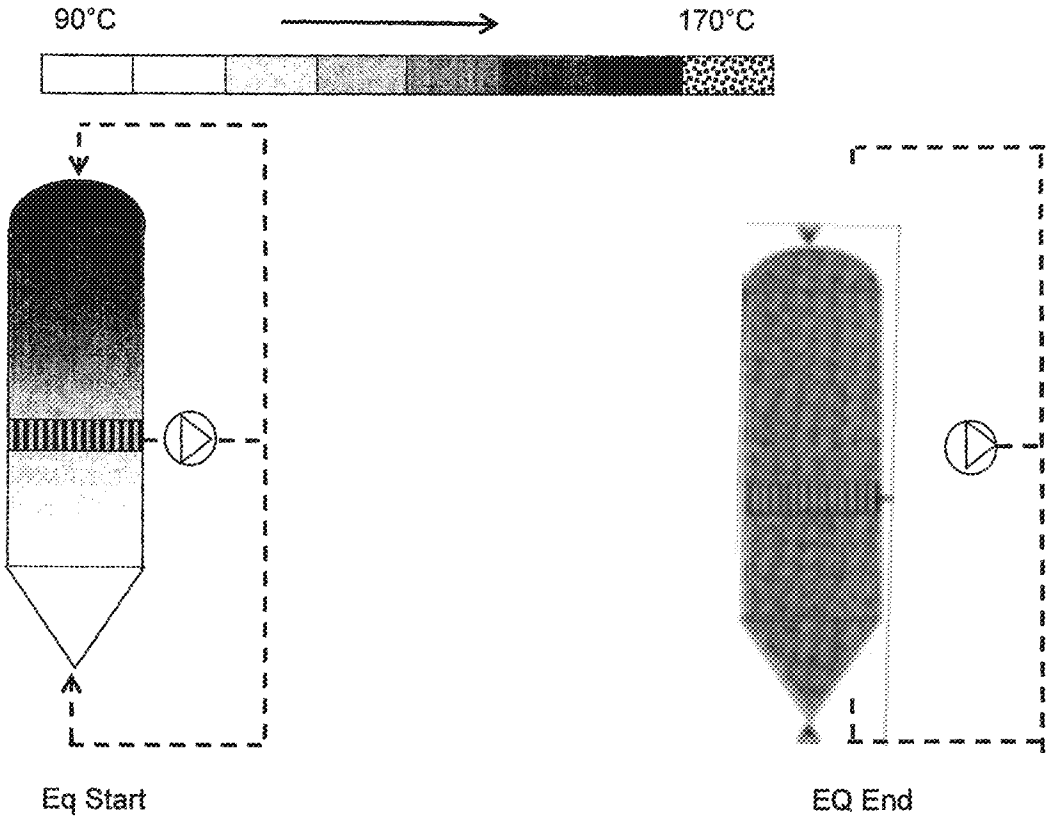
FIG. 2*b* is showing a conventional circulation phase after FIG. 2*a* in order to establish same temperature throughout the digester after the displacement.

This temperature profile may be even out by a circulation as shown in FIG. 2*b*, which starts from a condition corresponding to the rightmost hand figure in FIG. 2*a*, where a pump starts to withdraw liquor from mid-point liquid exchange position and return this liquor to both top and bottom. This will result in some heating in bottom and cooling in top and ideally the entire content of the digester assumes a temperature lying in-between the hot black liquor temperature and the hydrolysis temperature at end of circulation, as disclosed in the right hand figure.

Figure 3A:
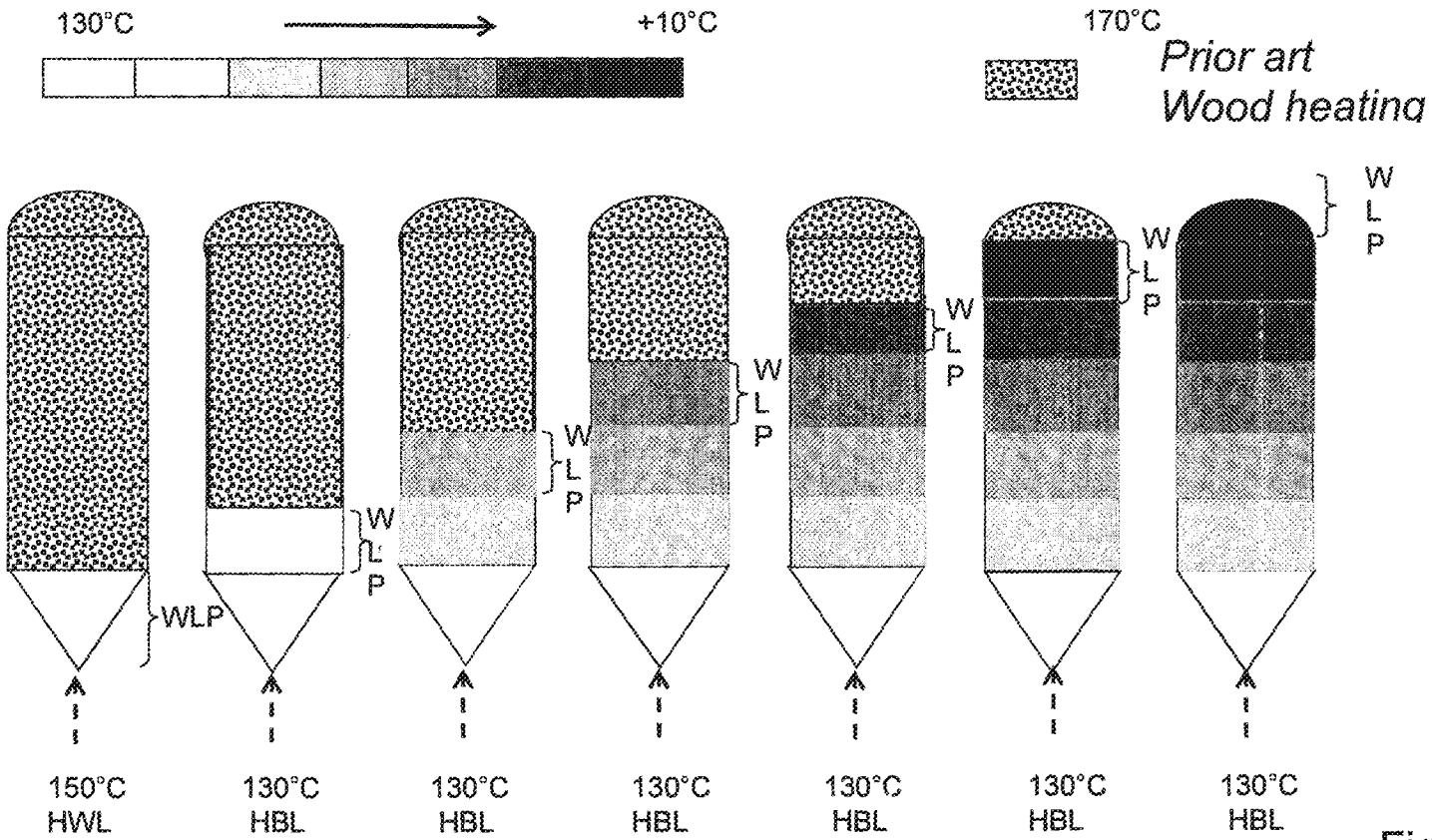
FIG. 3*a* is showing a principle effect heating from digester content during a conventional displacement front through the digester using a first white liquor pad WLP at a temperature of 150° C. displaced by hot black liquor at a temperature of 130° C.

In FIG. 3*a* is shown the additional principle heating effect from the residual heat content of the digester during a conventional displacement front through the digester using a hot white liquor pad at a temperature of 150° C. In this example is a drained digester shown with a digester content of comminuted chips after a heated treatment in form of a prehydrolysis conducted at 170° C. In a first stage, first left hand figure, of the displacement phase is the inlet cone part filled with a volume of hot white liquor holding 150° C. when added. In a second stage, second figure from left, of the displacement phase is the inlet cone part filled with a volume of hot black liquor holding 130° C. when added, pushing the first volume upwardly but now heated to a higher temperature by the digester content. This continues in stages until the entire digester is filled with displacement liquor, and as a result of the heating from the digester content is a temperature profile established over the height of the digester, with a temperature of the free liquor elevated some 10° C. in top but close to 130° C. in bottom. Now, the digester content in bottom has been flushed by 130° C. hot black liquor during the entire displacement and is very close to 130° C. But the digester content in top has only been drenched for a short time by heated white liquor that now holds a temperature of about 150+10° C., and has thus most of the heat value from hydrolysis left also in the digester content.

Figure 3B:
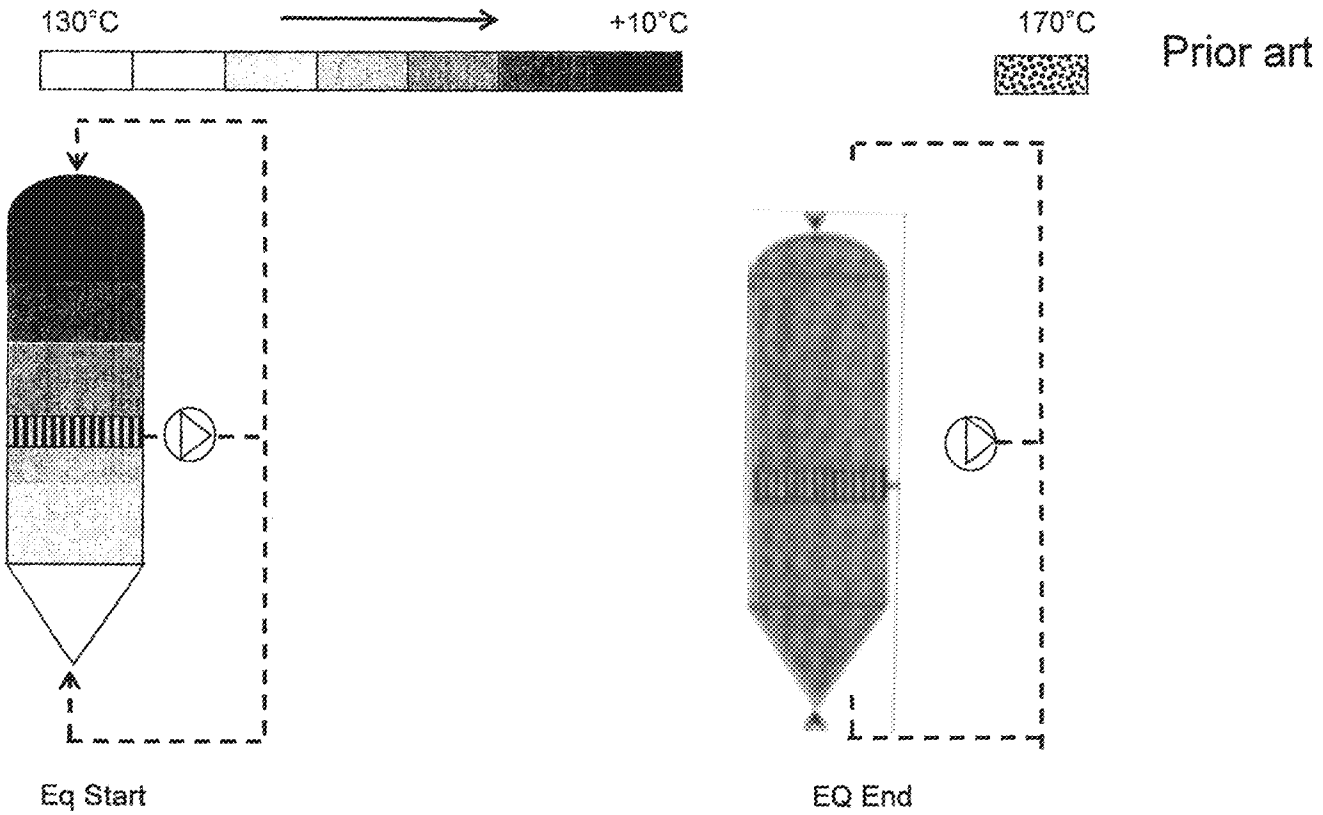
FIG. 3*b* is showing a conventional circulation phase after FIG. 3*a* in order to establish same temperature throughout the digester after the displacement.

This temperature profile may be even out by a circulation as shown in FIG. 3*b*, which starts from a condition corresponding to the rightmost hand figure in FIG. 3*a*, where a pump starts to withdraw liquor from mid-point liquid exchange position and return this liquor to both top and bottom. This will result in some heating in bottom and cooling in top and ideally the entire content of the digester assumes a temperature lying in-between the hot black liquor temperature, about 130° C., and the added heating from the digester material release, about 140° C., at end of circulation, as disclosed in the right hand figure.

These two examples in FIGS. 3*a* and 4*a* show the two independent heating effects from exothermic reactions and heating from digester material respectively, and that the usage of an isothermal displacement liquor results in a temperature profile in the digester, and hence is the digester content in top and bottom of digester subjected to quite a difference in H- or P-factor exposure resulting a variance in the pulp quality.

According to the invention a deliberate temperature profiling is instead implemented in the displacement liquor used, either as a part of a displacement pad or throughout a complete filling of the digester.

Embodiment in White Liquor Pad

Figure 4:
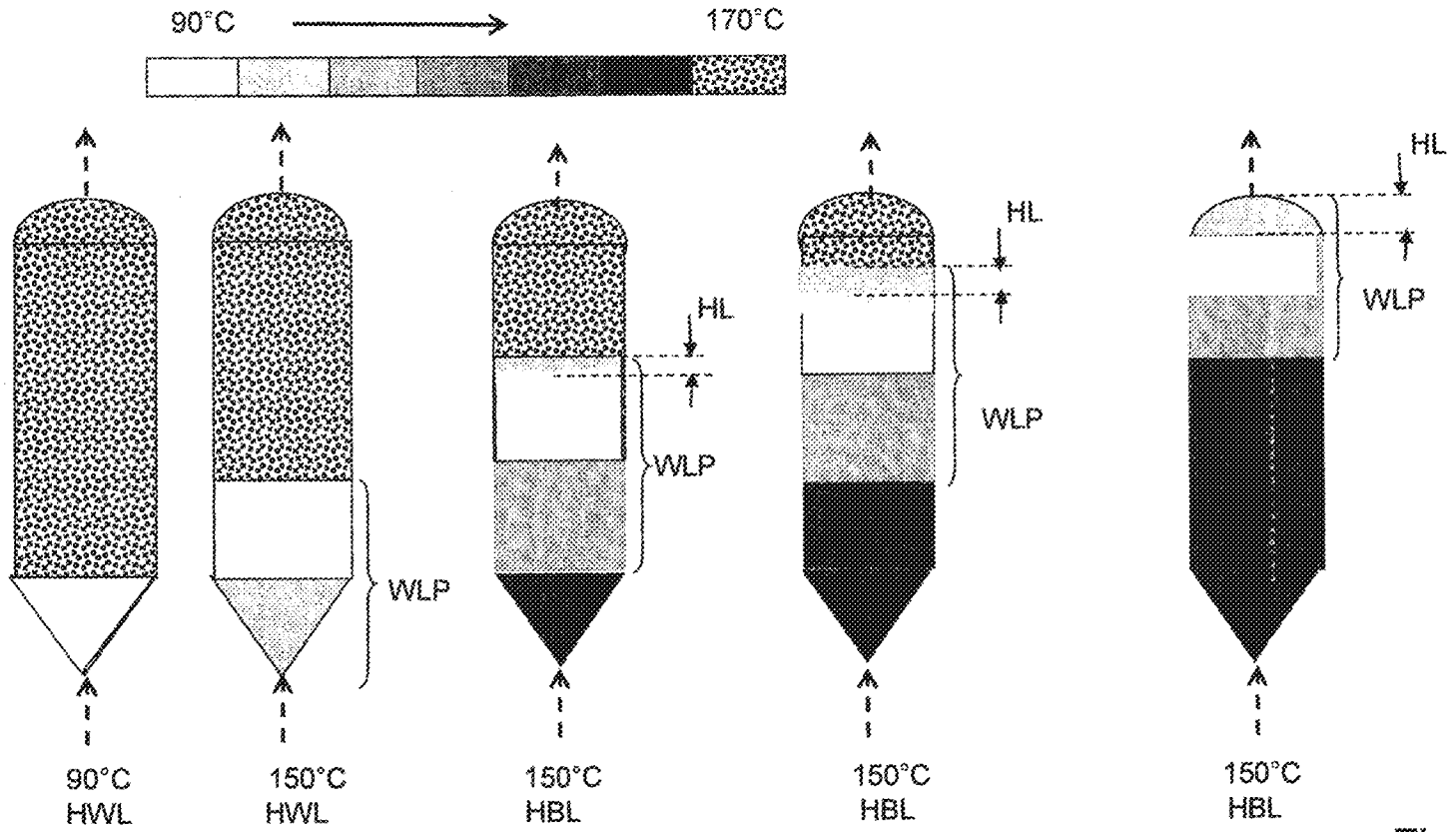
FIG. 4 is showing the principle effect of the inventive displacement front through the digester using a hot white liquor pad at successively higher temperature charged at 90° C. in first phase and up to 150° C. in a second phase.

In FIG. 4 is a first embodiment of the inventive displacement through the digester shown using displacement liquor, i.e. the one and same displacement liquor as of chemical content, which in at least 2 incremental steps, at temperatures of 90° C. and finally 150° C. is used. In this example a drained digester is shown with a digester content of comminuted chips after a heated treatment in form of a prehydrolysis conducted at 170° C. In a first stage, first left hand figure, of the displacement phase is the inlet cone part filled with a first volume of white liquor holding 90° C. when added. In a second stage, second figure from left, of the displacement phase is the inlet cone part filled with a second volume of hot white liquor holding 150° C. when added, pushing the first volume upwardly. The first and second volumes establish a white liquor pad (WLP) that is thereafter displaced trough the digester content by adding hot black liquor holding a temperature of about 150° C. With this temperature profiling of the white liquor, using an unheated white liquor in first phase, will this low temperature part of the WLP absorb the exothermic heat release as well has residual heat in the digester content, avoiding the temperature to become excessive. As indicated an upper layer of the first volume will be heated during displacement and this heated layer HL will increase during the displacement. Due to the initial low temperature at some 90° C., the heating from both exothermic reactions and residual heat in digester content will not be able to raise the temperature close to full hydrolysis temperature which will guarantee that the hydrolysis will be ended. This even if the alkali content has been depleted by the consumption during neutralization. The total volume of the White Liquor Pad WLP is 50-70% of the free volume inside digester and the first colder volume of the WLP is 20-50% of the WLP.

Embodiment in Digester Filling Phase

Figure 5A:
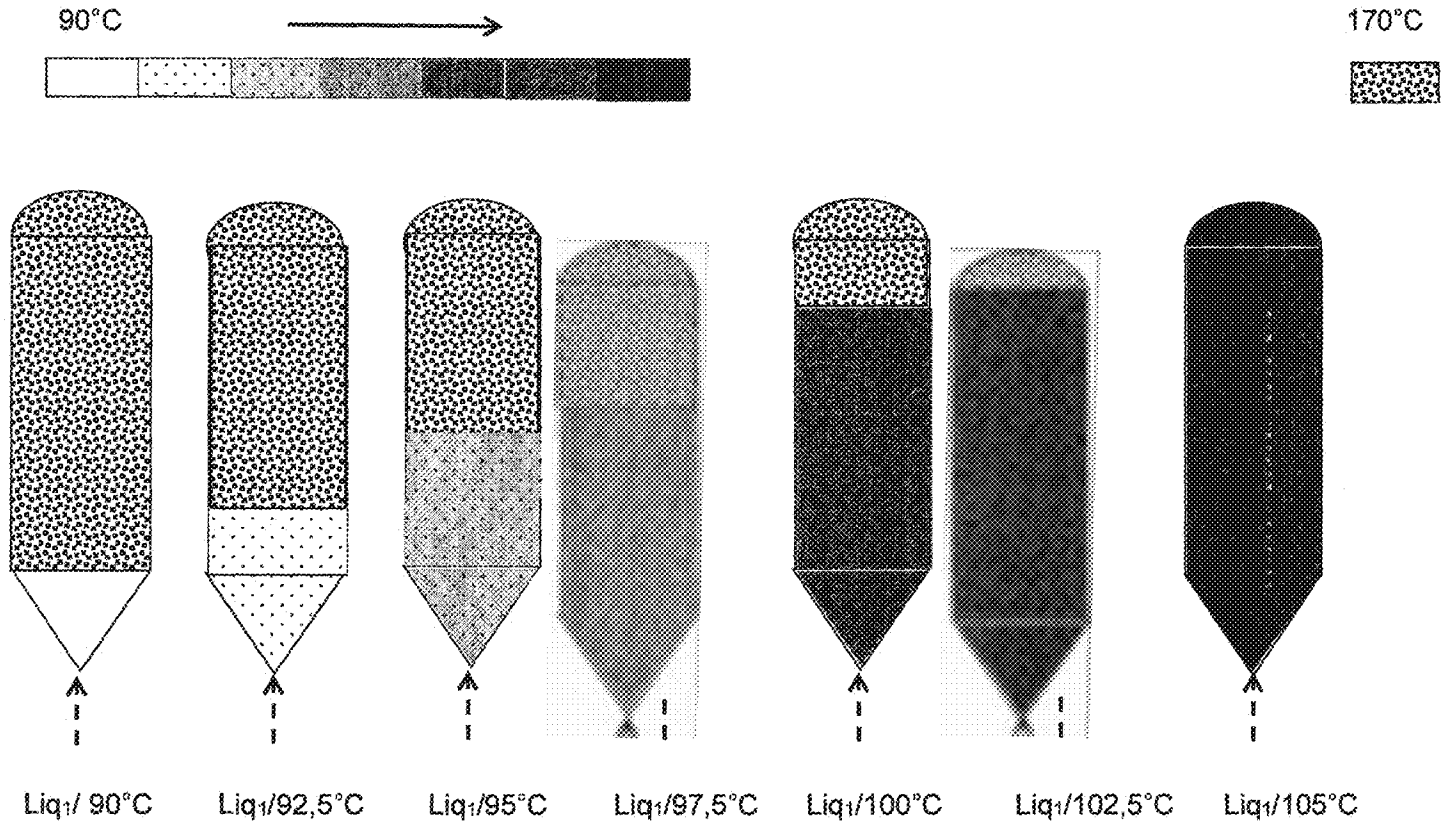
FIG. 5*a* is showing the principle effect of the inventive displacement front through the digester using a displacement liquor at successively higher temperature in 7 stages during complete filling of the digester.

In FIG. 5*a* is an alternative embodiment of the invention shown during a complete filling of the digester with one and the same liquor, but with a forced temperature profile. This temperature profiling may be implemented after the White Liquor Pad displacement as shown in FIG. 4.

The principle effect of the inventive displacement front through the digester shown using a displacement liquor, i.e. the one and same displacement liquor as of chemical content, that in at least 2 or 3 incremental steps, which in FIG. 5*a* are 7 incremental steps, at temperatures of 90-92.5-95-97.5-100-102.5 and finally 105° C. is used. In this example a drained digester is shown with a digester content of comminuted chips after a heated treatment in form of a prehydrolysis conducted at 170° C. In a first stage, first left hand figure, of the displacement phase is the inlet cone part filled with a volume of wash liquid holding 90° C. when added. In a second stage, second figure from left, of the displacement phase is the inlet cone part filled with a volume of wash liquid holding 92.5° C. when added, pushing the first volume upwardly but now heated to a higher temperature by the digester content to about 92.5° C. This continues in stages until the entire digester is filled with displacement liquor, and as a result of the heating from the digester content is an ISO temperature profile established over the height of the digester, with a temperature of the free liquor close to about 105° C. in the entire digester. The total heating effect is about 10° C. from exothermic reactions and about 10° C. from heat value in digester content. Now, the digester content in bottom has been flushed by liquor during the entire displacement and most of the heat value in the digester content has been absorbed in the liquor, while the digester content in top has only been drenched by heated liquor and has thus most of the heat value from hydrolysis left in the digester content.

Figure 5B:
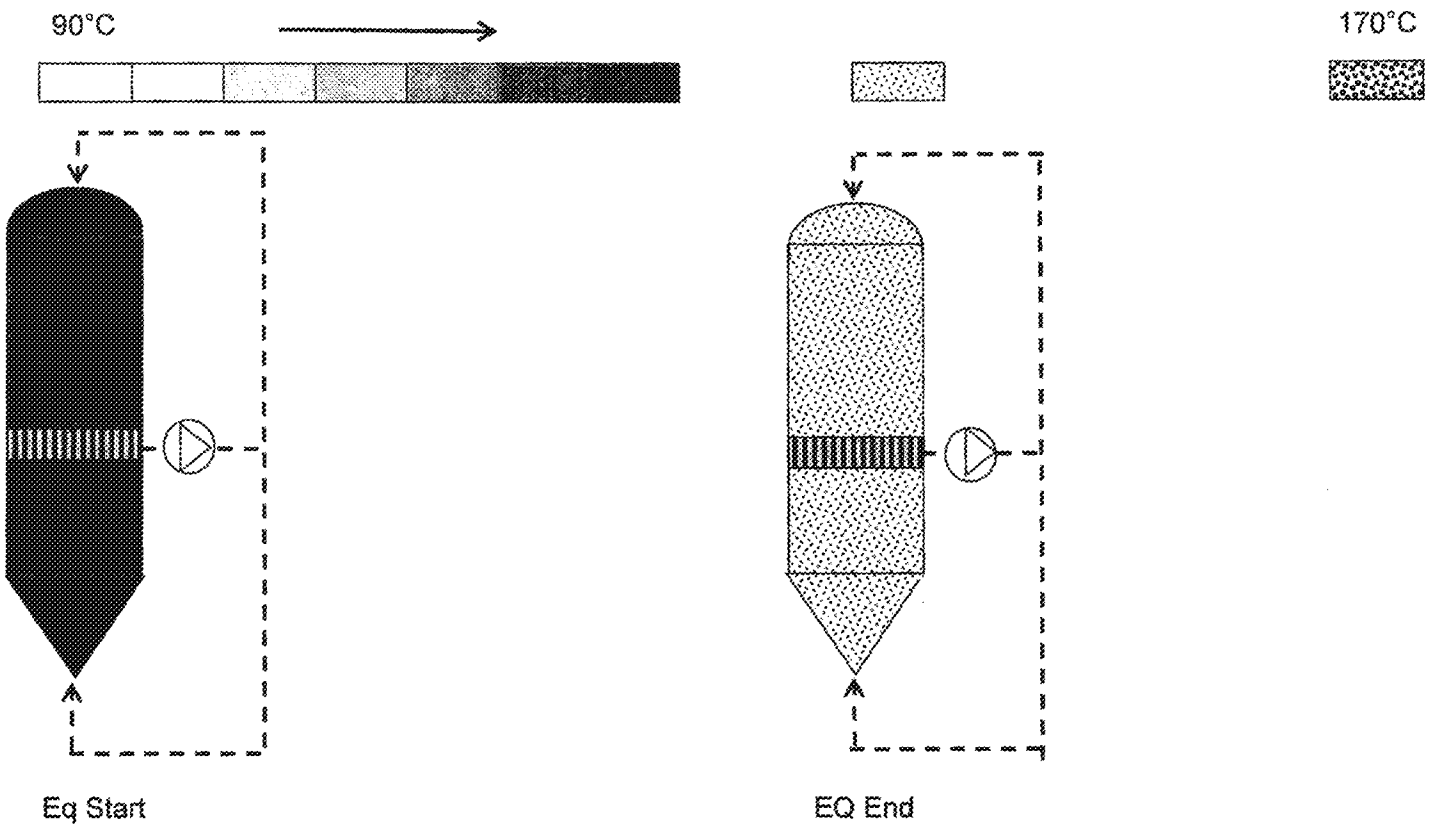
FIG. 5*b* is showing an optional circulation phase that may be implemented after FIG. 4*a* in order to absorb some of heat value still contained in the digester content.

This temperature profile may be even out by a circulation as shown in FIG. 5*b*, which starts from a condition corresponding to the rightmost hand figure in FIG. 4*a*, with an isothermal temperature profile of the free liquor, where a pump starts to withdraw liquor from mid-point liquid exchange position and return this liquor to both top and bottom. This will result in some heating of the free liquor by the excess residual heat in the digester content in top throughout the digester. Ideally, the entire content of the digester, both the chips and the free liquor, assumes a temperature lying somewhat above the temperature of the free liquor at end of displacement, as disclosed in the right hand figure.

Alternative Embodiments

Alternatively, the forced temperature profiling of the displacement liquor may even be modified so that the temperature of the free liquor in the final phase of displacement is not isothermal throughout the digester, but could still have a slight temperature profile with either colder or warmer temperature in final $7^{th}$ displacement phase. Hence, the digester content in bottom that is displaced by largest amount of displacement liquor may have the lowest residual heat value in the digester content, and therefore could the temperature increase be larger in the steps disclosed in FIG. 5*a*.

As the objective is to expose the digester content of iso-H factor exposure, could the forced temperature profiling be controlled exponentially so that the digester content may be exposed to less total cooling effect in latter stages of displacement, i.e. using less temperature increase in first 1-3 phases and then successively higher temperature increases in last 4-7 phases.

The effect of the temperature profiling could be controlled in the pulp finally blown from the digester, taking a sample of the first blow pulp and then a sample from the last blown pulp from the digester and compare pulp quality between these samples as of viscosity, tear strength or other pulp characteristics that may be effected by the specific displacement process.

If the inventive displacement process is implemented after a prehydrolysis, could for example differences in first and last blow pulp be compared as to residual content of hemicellulose that is supposed to dissolve during the prehydrolysis. If the first blown pulp, i.e. the digester content in bottom during treatment, has a higher content of hemicellulose, one may assume that the hydrolysis has not been obtained to the same extent as the last blown pulp thus suggesting an alteration of the temperature profiling towards a higher temperature in the lower part during the displacement phase.

Figure 1:
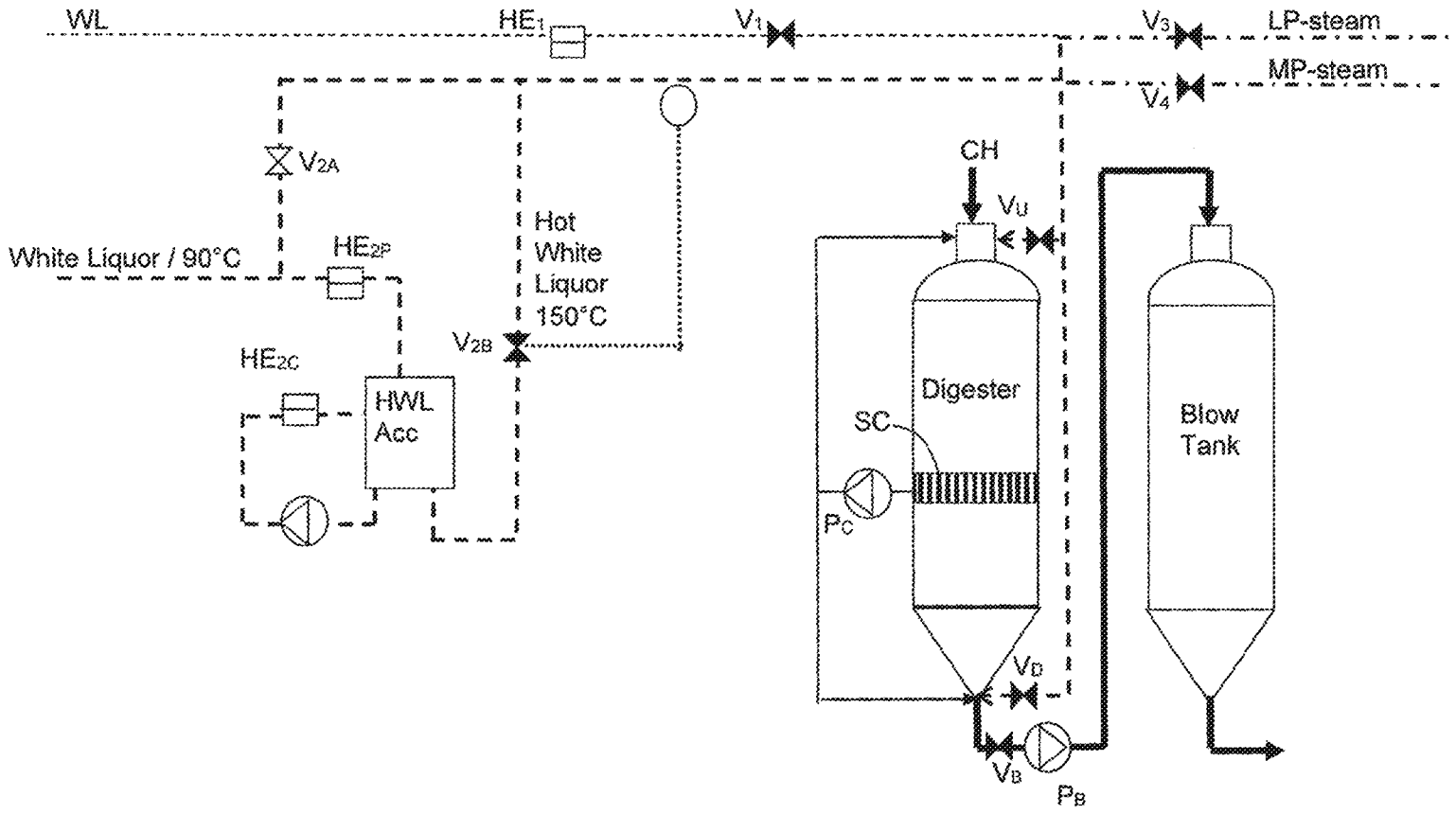
FIG. 1 is a schematic layout of a batch digester system with the components necessary to implement the invention in a white liquor displacement phase.

The temperature profiling during the displacement could easily be implemented in a principal system as that disclosed in FIG. 1 by using only unheated liquor (90° C.) in first phase, i.e. opening valve $V_{2A}$ while having valve $V_{2B}$ closed. Then as disclosed in figures could a change be implemented in several stages, gradually opening the valve $V_{2B}$ in steps as functionally disclosed in figures, or alternatively opening the valve gradually over the entire control process. The total volume of the liquor accumulator could thus be reduced considerably, as the total heated liquor volume is reduced in proportion to usage. The opening of the valve $V_{2B}$ may be controlled by a temperature sensor located after mixing of the unheated and heated wash liquors, as disclosed in FIG. 1.

While the temperature profiling has been disclosed after a prehydrolysis, the very same temperature profiling may be forced to any displacement liquor added to batch digester to end a preceding heated phase where temperature and time exposure on the digester content of cellulosic material play a role in that treatment phase. Thus, the Hot White Liquor accumulator shown in FIG. 1 may alternatively be a Wash Liquor or Hot Black Liquor accumulator.

While the present invention has been described in accordance with preferred compositions and embodiments, it is to be understood that certain substitutions and alterations may be made thereto without departing from the spirit and scope of the following claims.

I claim:

1. A method for ending a heated treatment phase in a displacement batch pulping process in a digester vessel, where the treatment phase has been done at a treatment temperature above 130° C., said digester having at least a bottom, a mid-point and a top liquid exchange position, the method initiated after the heated treatment phase and comprising the following steps;

adding a first displacement liquor to the bottom liquid exchange position while having a first lower temperature in the first displacement liquor at start of the displacement filling of a part of the digester with a first volume of the first displacement liquor, wherein the first lower temperature is more than 20° C. below the treatment temperature of the treatment phase;

continuing to add the same first displacement liquor to the bottom liquid exchange position while having a higher second temperature in the first displacement liquor in a later phase of the displacement filling at least a part of the digester with a total second volume of the first displacement liquor larger than the first volume; and continuing the displacement with a final displacement liquor; and the first lower temperature in the first displacement liquor is in a range 70-110° C.

2. The method according to claim 1 wherein the final displacement liquor is supplied and displaced until the content of the digester vessel is completely submerged under the total volume of the final displacement liquor added and wherein the first displacement liquor has been displaced from the digester via the top liquid exchange position.

3. The method according to claim 2, wherein a circulation of the liquor is initiated after the digester vessel has been filled by the final displacement liquor.

4. The method according to claim 1, wherein the proportion of the first volume of the first displacement liquor in relation to the total volume of the first displacement liquor is in a range 20-50%.

5. The method according to claim 3, wherein the total volume of the first displacement liquor is in a range 50-75% of the free digester volume.

6. The method according to claim 1, wherein the heated treatment phase is a prehydrolysis phase wherein the digester content is hydrolyzed at a temperature above 150° C.

7. A method for ending a heated treatment phase in a displacement batch pulping process in a digester vessel, where the treatment phase has been done at a treatment temperature above 130° C., said digester having at least a bottom, a mid-point and a top liquid exchange position, the method initiated after the heated treatment phase and comprising the following steps;

adding a first displacement liquor to the bottom liquid exchange position while having a first lower temperature in the first displacement liquor at start of the displacement filling of a part of the digester with a first volume of the first displacement liquor, wherein the first lower temperature is more than 20° C. below the treatment temperature of the treatment phase;

continuing to add the same first displacement liquor to the bottom liquid exchange position while having a higher second temperature in the first displacement liquor in a later phase of the displacement filling at least a part of the digester with a total second volume of the first displacement liquor larger than the first volume;

continuing the displacement with a final displacement liquor; and wherein after adding the first displacement liquor with the higher second temperature and before the content of the digester vessel is completely submerged is the displacement continuing by adding the same first displacement liquor to the bottom liquid exchange position while having a third temperature higher than the second temperature in the displacement liquor in a later phase of the displacement filling a part of the digester with a total third volume of first displacement liquor larger than the total second volume.

8. The method according to claim 7, wherein the temperature in the first displacement liquor increase is done in incremental steps in at least 3 and up to 10 steps during the displacement.

9. The method according to claim 7, wherein the temperature increase in the first displacement liquor is done continuously during the displacement.

* * * * *